US005752458A

United States Patent [19]

Morita

[11] Patent Number: 5,752,458

[45] Date of Patent: May 19, 1998

[54] STITCHING DATA PROCESSING DEVICE CAPABLE OF OPTIONALLY DISPLAYING STITCHING PERIOD OF TIME

[75] Inventor: Nami Morita, Nagoya, Japan

[73] Assignee: Brother Kogyo Kabushiki Kaisha, Nagoya, Japan

[21] Appl. No.: 732,980

[22] Filed: Oct. 16, 1996

[30] Foreign Application Priority Data

Oct. 17, 1995 [JP] Japan ..... 7-294841

[51] Int. Cl.[6] ..... D05C 5/02; D05B 21/00

[52] U.S. Cl. ..... 112/102.5; 112/470.04; 112/445

[58] Field of Search ..... 112/102.5, 470.01, 112/470.04, 470.06, 454, 456, 457, 458, 445; 364/470.09

[56] References Cited

U.S. PATENT DOCUMENTS 5,228,403 7/1993 Sugimoto ..... 112/102.5 X 5,239,475 8/1993 Shigeta et al. ..... 112/456 X 5,474,002 12/1995 Goto et al. ..... 112/102.5

FOREIGN PATENT DOCUMENTS

A-62-57585 3/1987 Japan .

A-62-57588 3/1987 Japan .

*Primary Examiner*—Peter Nerbun

*Attorney, Agent, or Firm*—Oliff & Berridge P.L.C.

[57] ABSTRACT

Pattern display data and embroidery data are stored in a card ROM that is usable in a sewing machine. Based on the pattern display data, a predetermined number of embroidery patterns are displayed in a display unit mounted on the sewing machine. After a desired embroidery pattern is selected, an operator may depress a stitching time key if he or she wants to know a stitching period of time for the embroidery pattern selected. When the key is depressed, the stitching period of time is computed based on the corresponding embroidery data stored in the card ROM. The resultant stitching period of time is displayed in conjunction with the selected embroidery pattern. As such, the operator can recognize the stitching period of time before start of embroidery stitching.

17 Claims, 10 Drawing Sheets

STITCHING DATA PROCESSING DEVICE CAPABLE OF OPTIONALLY DISPLAYING STITCHING PERIOD OF TIME

BACKGROUND OF THE INVENTION

1. Field of the Invention

The present invention relates to a stitching data processing device capable of displaying examples of embroidery patterns for an operator's choice. More particularly, the invention relates to the stitching data processing device capable of optionally displaying a stitching period of time for each example of the embroidery patterns displayed in a display unit.

2. Description of the Related Art

There has been known a stitching data processing device, such as an electrically controlled sewing machine having a control unit. The control unit is provided with a non-volatile memory storing pattern data for stitching a plurality of different categories of embroidery patterns, such as ornamental embroidery patterns, one point embroidery patterns, character embroidery patterns, and other embroidery patterns. The sewing machine also includes a display unit having a large liquid crystal display. The display unit displays embroidery pattern examples belonging to a selected embroidery category when an operator depresses a category selection key. From the embroidery pattern examples displayed in the display unit, the operator can select a desired embroidery pattern. Recent sewing machines are further capable of displaying a stitching period of time for stitching the selected embroidery pattern.

Japanese Laid-Open Patent Publications Sho-62-57585 and Sho-62-57588 disclose displaying a stitching period of time in a liquid crystal display (LCD) computed based on stitching data stored in a PROM. The stitching period of time is given by a sum of a stitch involving time involved in stitching and a fabric feeding time for feeding a fabric workpiece without stitching. The stitch involving time is computed by multiplying one seam forming period of time and a stitch number derived from the corresponding stitching data. The fabric feeding time is computed by multiplying the fabric feeding number and a time for each fabric feeding. Stitching of the embroidery pattern is commenced upon notifying the operator of the stitching period of time thus computed. The displayed stitching period of time may be determined to include a period of time for attaching and detaching a fabric workpiece.

The above-described conventional sewing machines are inconvenient when the same embroidery pattern is repeatedly stitched. Notwithstanding the fact that the stitching period of time or the total stitching period of time for the selected embroidery pattern was computed and displayed when the first embroidery stitching was performed, the computation of the stitching period of time will be performed each time the embroidery pattern is to be stitched. As a result, a cycle time from the start to the end of each stitch is unduly prolonged, thereby lowering the efficiency of the stitching operation.

SUMMARY OF THE INVENTION

The present invention has been made to eliminate the aforementioned inconvenience of the conventional sewing machines, and accordingly it is an object of the present invention to provide a stitching data processing device wherein a stitching period of time for a selected embroidery pattern can be optionally displayed in a display unit, that is, the embroidery pattern is displayed if an operator wants to display it, and the display of the stitching period of time can be dispensed with if the display thereof is not necessary, thereby increasing the efficiency of the embroidery stitching operations.

In order to achieve the above and other objects, there is provided, according to one aspect of the present invention, a stitching data processing device that includes a display unit, data storage means, pattern display control means, input means, time computing means, and time display control means. The data storage means is, for example, a card ROM, and stores therein a plurality of pieces of pattern data. The pattern data is for a plurality of embroidery patterns, wherein each embroidery pattern is stitched by at least one color thread. The pattern display control means displays at least one embroidery pattern in the display unit based on selected one of the plurality of pieces of pattern data. The input means is provided for inputting a time display instruction for instructing to display in the display unit a stitching period of time for the at least one embroidery pattern. The time display instruction is optionally input by an operator. The time computing means is provided for computing the stitching period of time for the at least one embroidery pattern when the operator inputs the time display instruction with the input means and for outputting time data representative of a computed stitching period of time. The time display control means is provided for displaying the computed stitching period of time in the display unit based on the time data output from the time computing means.

The time computing means computes the stitching period of time on an embroidery pattern basis, and the time display control means displays the computed stitching period of time in association with a corresponding embroidery pattern displayed in the display unit.

Preferably, category display control means is provided for displaying in the display unit a plurality of categories corresponding to the plurality of pieces of pattern data, respectively, and a category selection means for allowing the operator to select a category out of the plurality of categories. The pattern display control means displays a predetermined number of embroidery patterns in the display unit based on one of the plurality of pieces of pattern data corresponding to the category selected by the operator.

Preferably, the category selection means includes a plurality of touch switches provided corresponding to the plurality of categories displayed in the display unit. Each of the plurality of touch switches is a transparent electrode disposed in an overlapping relation to the corresponding category displayed in the display unit.

The data storage means stores pattern display data, embroidery pattern data, and a leading address of the embroidery pattern data with respect to each of the plurality of embroidery patterns. The pattern display control means sequentially displays the predetermined number of embroidery patterns in the display unit based on the pattern display data and the leading addresses of the plurality of embroidery patterns.

Selection means may further be provided for allowing the operator to select one of a predetermined number of embroidery patterns displayed in the display unit. The selection means is operative when the operator has not yet inputted the time display instruction with the input means. Segmental embroidery pattern display control means is also provided for displaying segmental embroidery patterns. Each of the segmental embroidery patterns is extracted on a color thread basis from the one of the predetermined number of embroidery patterns selected by the operator. The segmental embroidery patterns are displayed sequentially in an order of stitching of the one of the predetermined number of embroidery patterns selected by the operator.

When the operator inputs the time display instruction with the input means under a condition when the operator has selected the one of the predetermined number of embroidery patterns, the time computing means computes a stitching time of the embroidery pattern selected by the operator and the time display control means displays the computed stitching period of time for the selected embroidery pattern in the display unit. Execution means is further provided for executing a stitching of the selected embroidery pattern, the execution means being operated by the operator.

According to another aspect of the present invention, there is provided a stitching data processing device that includes a display unit, data storage means, pattern display control means, time computing means, selection means, and prohibiting means. The data storage means stores therein embroidery data for a plurality of embroidery patterns. Each of the plurality of embroidery patterns is stitched by at least one color thread. The pattern display control means is provided for displaying a predetermined number of embroidery patterns in the display unit based on the embroidery data. The time computing means is provided for computing a stitching period of time for each of the predetermined number of embroidery patterns based on the embroidery data and for outputting time data representative of a computed stitching period of time. The selection means is provided for selecting whether or not computation of the stitching period of time by the time computing means is prohibited. The prohibiting means prohibits the time computing means from computing the stitching period of time when the selection means indicates that computation of the stitching period of time is prohibited.

Embroidery pattern selection means may further be provided for allowing the operator to select one of the predetermined number of embroidery patterns displayed in the display unit. Segmental embroidery pattern display control means is also provided for displaying segmental embroidery patterns. Each of the segmental embroidery patterns is extracted on a color thread basis from the one of the predetermined number of embroidery patterns selected by the operator. The segmental embroidery patterns are displayed sequentially in an order of stitching of the one of the predetermined number of embroidery patterns selected by the operator.

When the selection means indicates that computation of the stitching period of time is not prohibited, the time computing means computes a stitching time of the embroidery pattern selected by the operator and the time display control means displays the computed stitching period of time for the selected embroidery pattern in the display unit.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

A preferred embodiment of the present invention will be described with reference to the accompanying drawings. The embodiment is concerned with a stitching data processing device incorporated in an electrically controlled zigzag sewing machine to which an embroidery sewing device is detachably mounted.

Figure 1:
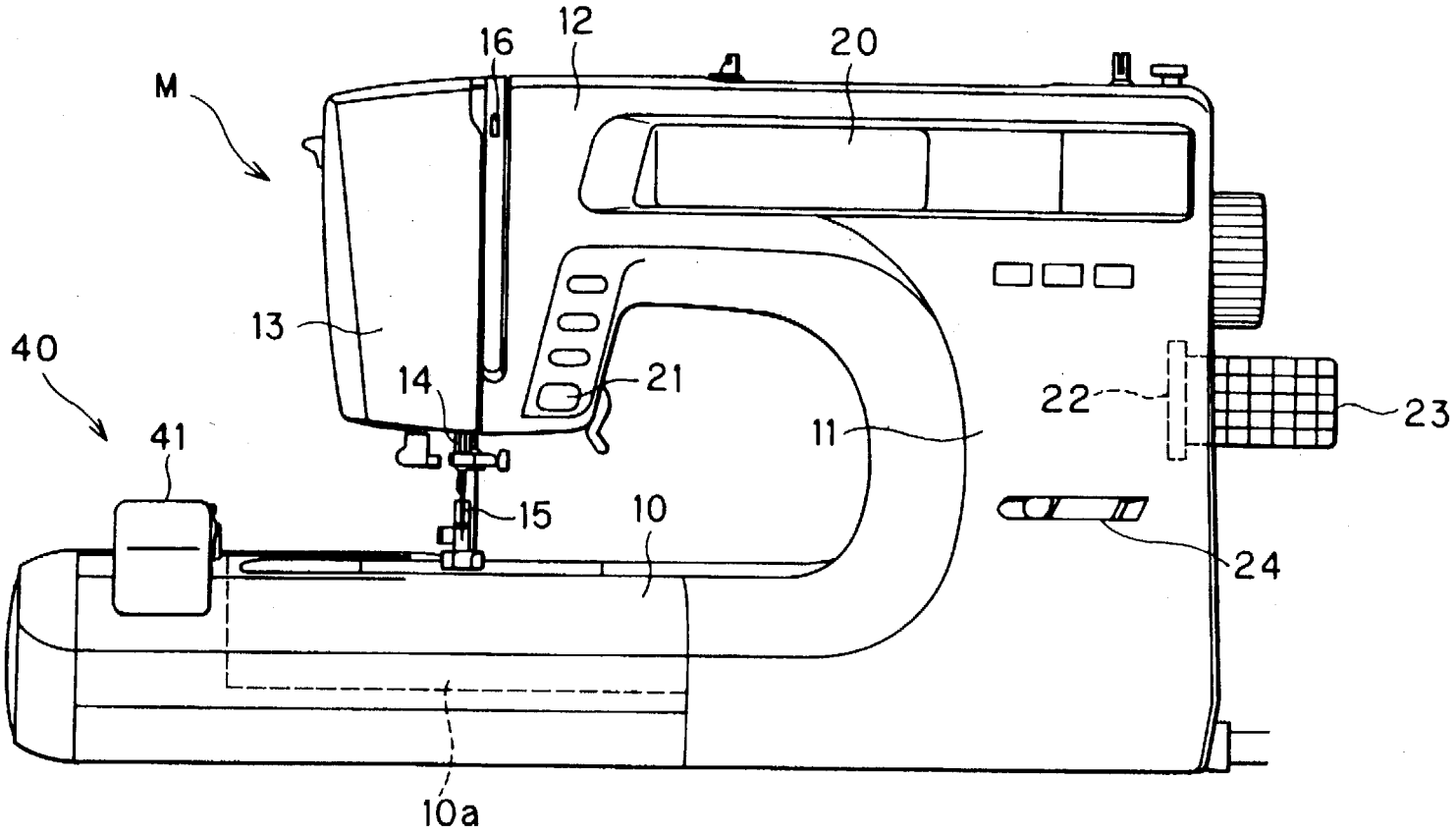
FIG. 1 a front view showing an electrically controlled zigzag sewing machine provided with an embroidery device according to one embodiment of the present invention.

As shown in FIG. 1, the electrically controlled zigzag sewing machine M includes a bed portion 10; a column portion 11 provided with an upright posture at the right tip portion of the bed portion 10 as viewed in FIG. 1; and an arm portion 12 extending from the column portion 11 leftward as viewed in FIG. 1 in parallel with the bed portion 10. Although not shown in the drawings, a feed dog vertical movement mechanism for vertically driving a feed dog and feed dog horizontal movement mechanism for horizontally driving the feed dog are provided to the bed portion 10.

Figure 2:
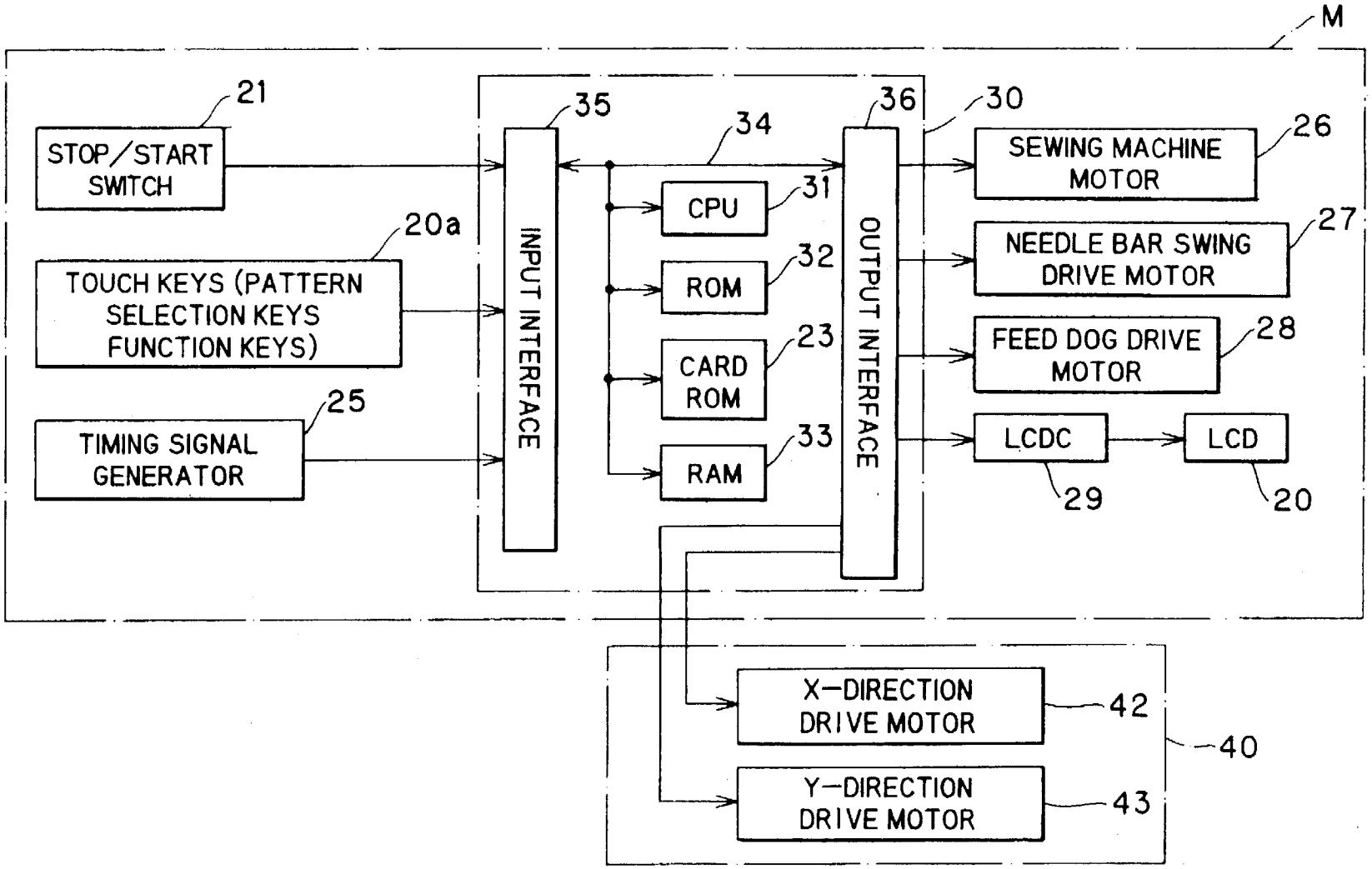
FIG. 2 is a block diagram showing a control system for the sewing machine and the embroidery device.

Although not shown in the drawings, the arm portion 12 is provided with a needle bar drive mechanism for vertically driving a needle bar 14 with a needle 15 mounted to its lower tip; a needle bar swinging mechanism for swinging the needle bar 14 in a direction perpendicular to the direction in which the workpiece cloth is fed; and a thread take up lever mechanism (not shown) for vertically driving a take up thread lever 16 in timed relation to vertical drive of the needle bar 14. As shown in FIG. 2, a sewing machine motor 26 is provided for driving the needle bar drive mechanism, the thread take up lever drive movement mechanism, and the feed dog vertical movement mechanism; a needle bar swing drive motor 27 is provided for driving the needle bar swing mechanism; and a feed dog drive motor 28 is provided for driving the feed dog horizontal movement mechanism.

A liquid crystal display unit 20 capable of displaying a plurality of embroidery patterns and a variety of messages is provided to the front surface of the arm portion 12. A plurality of touch keys 20*a* formed from transparent electrodes are provided to the display region of display unit 20. The touch keys 20*a* serve as pattern selection keys for selecting patterns from embroidery patterns displayed on the display unit 20 and also serve as function keys displayed with function names. A start/stop switch 21 for commanding start and stop of sewing operations is provided in the vicinity of a head portion 13 of the arm portion 12. The column portion 11 is provided with a memory card mounting connector 22 for detachably mounting card ROMs 23, which serve as an external memory; and a speed changing knob 24 for adjusting sewing speed.

A free arm portion 10*a* is formed to the left tip of the bed portion 10. An embroidery device 40 capable of sewing large embroidery patterns is detachably mounted to the free arm portion 10*a*.

An embroidery table 41 is provided to the embroidery device 40 so as to be movable in both a Y-direction in parallel to a fabric feeding direction and an X-direction perpendicular to the Y-direction. Although not shown in the drawings, a cloth support frame for supporting the workpiece cloth can be detachably mounted to the embroidery table 41. An X-direction drive motor 42 for driving the embroidery table 41 in the X-direction and a Y-direction drive motor 43 for driving the embroidery table 41 in the Y-direction are provided within the embroidery device 40.

Next, a control system for the sewing machine 1 and the embroidery device 40 will be described while referring to the block diagram shown in FIG. 2.

The control device 30 of the sewing machine M includes a microcomputer, an input interface 35, and an output interface 36. The microcomputer includes a CPU 31, a ROM 32, a card ROM 23, and a RAM 33. The input interface 35 and the output interface 36 are connected to the microcomputer via a bus 34, such as a data bus. Signals from the start/stop switch 21, the touch keys 20*a*, and a timing signal generator 25 are supplied to the microcomputer through the input interface 35. Drive signals and drive pulse signals for driving the sewing machine motor 26, the needle bar swing drive motor 27, the feed dog drive motor 28, and a liquid crystal display controller (LCDC) 29, which is for supplying display signals to the display unit 20, are supplied from the microcomputer through the output interface 36.

A timing signal generator 25 is connected to the upper shaft of the sewing machine M to detect rotational phase of the upper shaft.

The output interface 36 is connected to the X-direction drive motor 42 and the Y-direction drive motor 43 of the embroidery device 40. The drive motors 42, 43 are independently driven based on separate drive signals output from the control unit 30 to move the embroidery table 41 to a particular position for each stitch using a combination of movements in the X- and Y-directions, thereby enabling sewing of a variety of embroidery patterns in the workpiece cloth supported in the cloth support frame. A stitching data processing device is constructed with the control unit 30, the display unit 20, and touch keys 20*a*.

Figure 3:
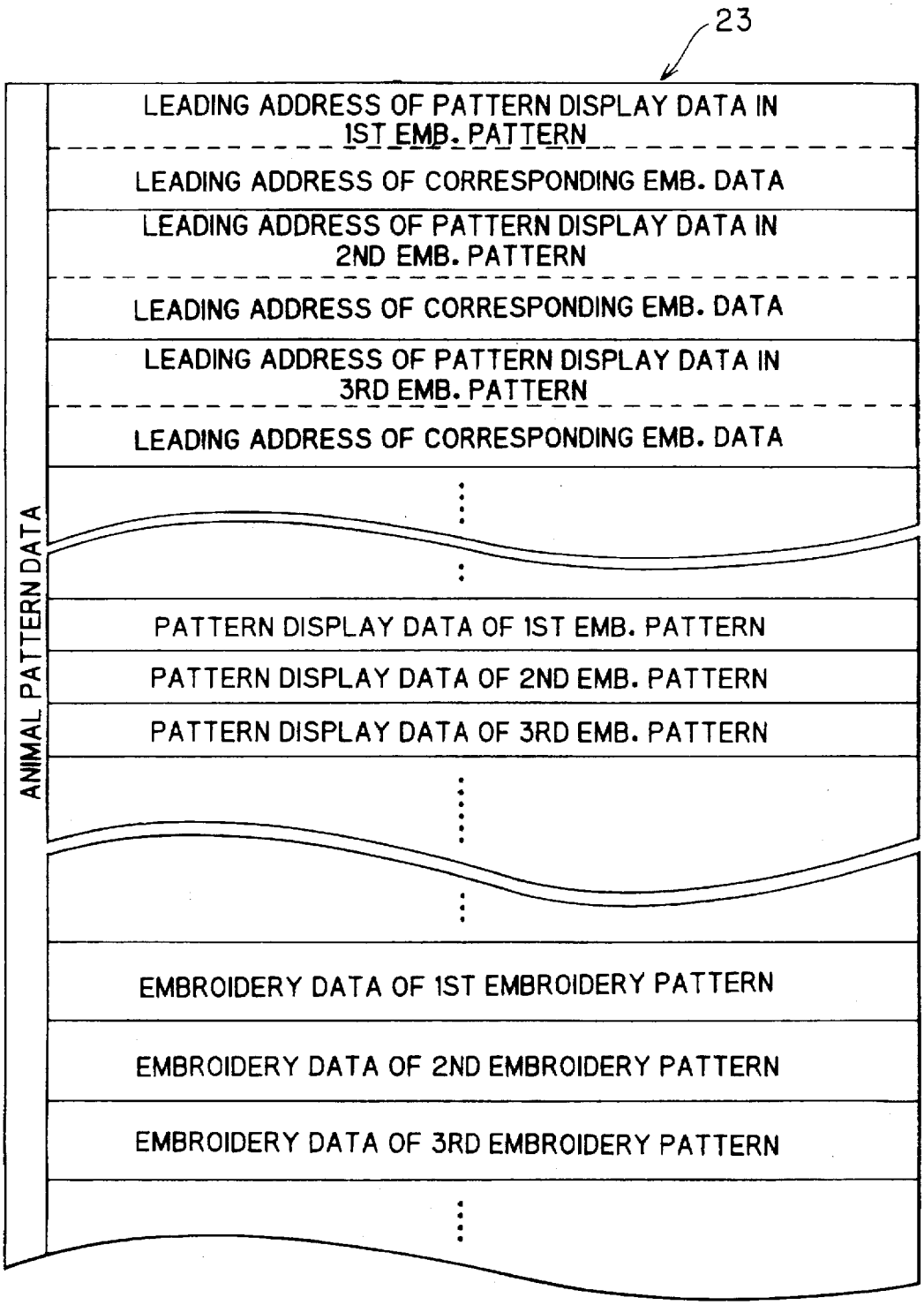
FIG. 3 is an explanatory diagram illustrating a structure of pattern data stored in a card ROM.

The card ROM 23 has stored therein pattern data including embroidery data for sewing, and pattern display data for displaying a variety of embroidery patterns that are classified into several groups, such as "animal" embroidery patterns including an elephant pattern and a horse pattern, "people" embroidery patterns, and "character/symbol" embroidery patterns including alphanumerals, and symbol marks. For example, as shown in FIG. 3, the pattern data regarding the "animal" embroidery patterns includes a leading address of pattern display data in a first embroidery pattern (panda), and a leading address of the first embroidery data, a leading address of pattern display data in a second embroidery pattern (elephant), and a leading address of the second embroidery data, a leading address of pattern display data in a third embroidery pattern (horse), and a leading address of the third embroidery data, and so on.

The pattern data of the first, second, third embroidery patterns and so on are sequentially stored in the card ROM 23, and the embroidery data corresponding to the first, second, third embroidery patterns and so on are also sequentially stored therein. The pattern display data and the embroidery data for the various embroidery patterns falling in the categories of "people" and "character/symbols" are also stored in the card ROM 23 on the category basis. The pattern display data and the embroidery data relating to the embroidery pattern constitute pattern data.

The embroidery data is representative of needle locations and is given by values on absolute or relative coordinates corresponding to a fabric supporting frame. Based on the embroidery data, the workpiece fabric is moved relative to a needle 14 by the embroidery device 40. The embroidery data may represent all of the needle positions or apex positions of blocks, such as triangle, rectangle, into which the embroidery pattern is divided.

The embroidery pattern can be divided into a plurality of pattern segments on a color basis so that the embroidery pattern may be stitched using different color threads. The pattern display data is constructed with plural pieces of segmental pattern display data. Thread change instruction data is added to the trailing portion of each segmental pattern display data for instructing the operator to stop stitching the embroidery for replacement of the thread.

The ROM 32 has stored therein control programs including an embroidery pattern display control program to be described later and a stitch control program. The stitch control program is for controlling the drive motors 27 and 28 based on embroidery data for performing zigzag stitches or triple stitches, or for controlling the drive motors 42 and 43 for performing embroidery stitches based on embroidery data. The RAM 33 is provided with buffers and counters which are necessary for executing the embroidery pattern display control and the stitch control.

An embroidery pattern display control routine to be executed by the control device 30 of the sewing machine M will be described while referring to the flowcharts shown in FIGS. 4 and 5 wherein Si (I=10, 11, 12 . . . ) indicates individual step numbers of the routine.

Figure 6:
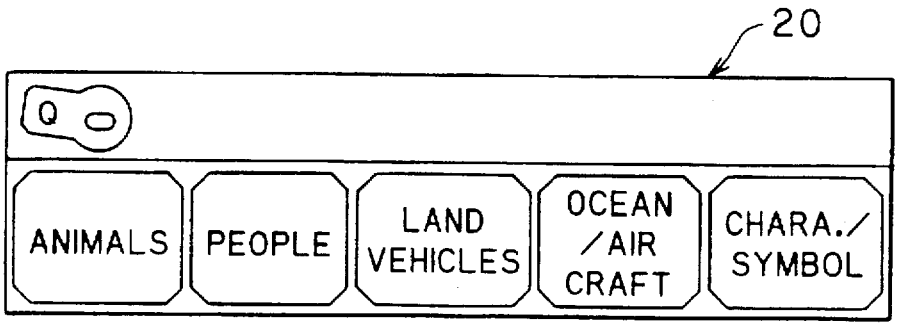
FIG. 6 is an explanatory diagram showing category names of stitchable embroidery patterns displayed in a display unit.
Figure 7:
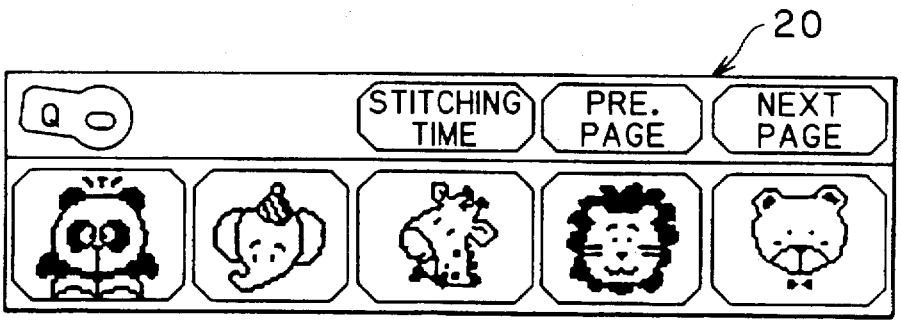
FIG. 7 is an explanatory diagram showing a group of animal embroidery patterns displayed in the display unit according to the embodiment of the present invention.

The control starts when the sewing machine M is powered. First, a category selection screen is displayed in the display unit 20 for selection of a desired category of embroidery patterns (S10). For example, as shown in FIG. 6, the display unit 20 displays such categories as "Animals", "People", "Land Vehicles", "Ocean/Air Craft", and "Character/Symbol". A desired category can be selected upon depressing the corresponding touch key 20*a*, whereupon an embroidery pattern category selection process is executed (S11). In this process, a first set of embroidery patterns of the selected category is displayed in the display unit 20 (S12). When, for example, the category of "Animals" is selected, the first five animal embroidery patterns corresponding to the first to fifth embroidery patterns stored in the card ROM 23 are displayed as shown in FIG. 7.

When the touch key 20*a* corresponding to "Next Page" is depressed (S13, S14: Yes), next five animal embroidery patterns are displayed (S18), whereupon the routine returns to S13. When the touch key 20*a* corresponding to "Previous Page" is depressed (S13: Yes, S14: No, S15: Yes), the previous five animal embroidery patterns are displayed (S19), whereupon the routine returns to S13. When the touch key 20*a* corresponding to the "Stitching Time" is depressed to display a stitching time (Sl3: Yes, S14, S15: No, S16: Yes), computation of stitching time is performed with respect to all the embroidery patterns currently displayed in the display unit 20 (S20).

Figure 8:
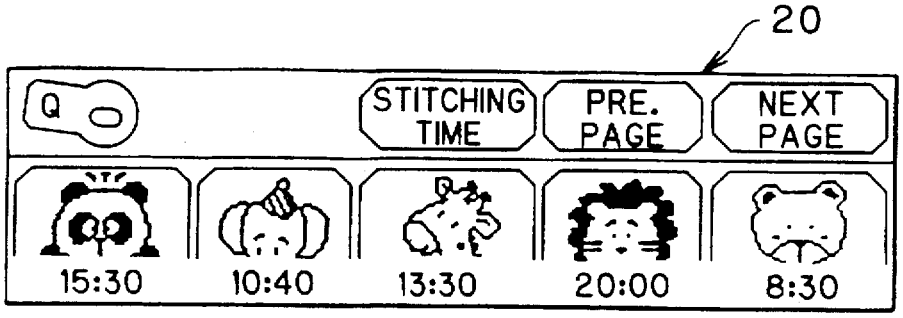
FIG. 8 is an explanatory diagram showing a display of stitching times in addition to the animal embroidery patterns.

In this stitching time computing process, the stitching time for each of the embroidery patterns is computed based on the corresponding embroidery data and a stitching speed set for the embroidery pattern. Specifically, the stitching time is given by multiplying the number of stitches and a cycle time for one stitch. The stitching times computed for all the embroidery patterns are displayed in positions corresponding to the embroidery patterns (S21), whereupon the routine returns to S13. When the embroidery patterns of panda, elephant, giraffe, lion, and bear are displayed in the display unit 20 as shown in FIG. 7, the computed stitching times are displayed in minutes:seconds format immediately below the positions where those animal embroidery patterns are displayed as shown in FIG. 8.

Figure 9:
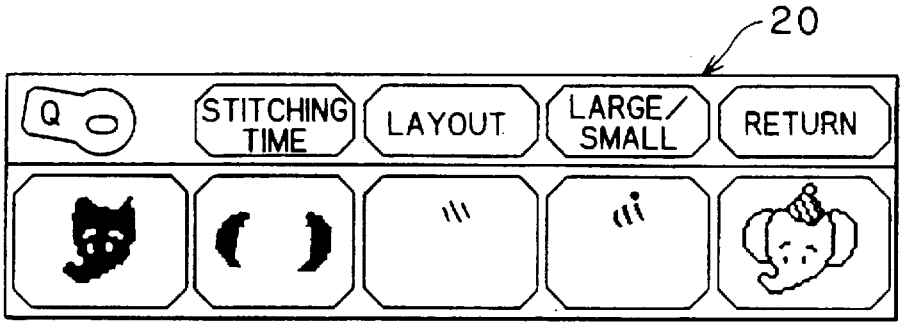
FIG. 9 is an explanatory diagram showing a display of color-based pattern components making up of an elephant embroidery.

When the touch key 20*a* corresponding to the desired embroidery pattern is depressed (S13: Yes, S14, S15, S16: No, S17: Yes), a pattern selection process control as illustrated in the flowchart of FIG. 5 is executed (S22). In this case, the depressed touch key 20*a* serves as a pattern selection key. When this control starts, pattern display data for the embroidery pattern as specified by the touch key 20*a* is read from the card ROM 23, and a plurality of color-based segmental patterns are sequentially displayed in an order to be stitched (S30). For example, when the embroidery pattern of elephant is selected, five pattern components making up the embroidery pattern of the elephant are sequentially displayed as shown in FIG. 9.

Figure 10:
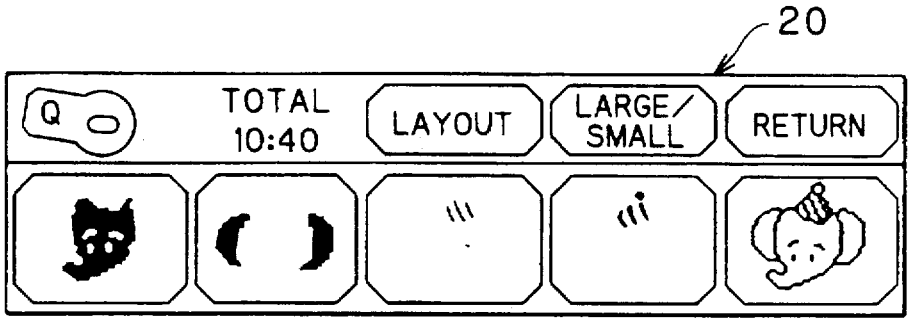
FIG. 10 is an explanatory diagram showing a display of a total stitching time in addition to the display of color-based pattern components of the elephant embroidery.

When the stitching time key is depressed to display the stitching time for the specified embroidery pattern (S31, S32: Yes), the stitching time for stitching the embroidery is computed based on the embroidery data of the specified embroidery pattern and the stitching speed thereof similar to the processes in S18 and S19 (S36). The computed stitching time is displayed in the display unit 20 (S37), whereupon the routine returns to S31. For example, as shown in FIG. 10, the stitching time 10:40 (10 minutes and 40 seconds) computed for the embroidery pattern of elephant is displayed in the display unit 20.

When the return key is depressed (S31: Yes, S32: No, S33: Yes), the embroidery patterns belonging to the currently selected embroidery pattern group are displayed in the display unit 20 (S38), whereupon the routine returns to S13 of the embroidery pattern display control. In this condition, the operator can again select a desired embroidery pattern for the subsequent stitching. On the other hand, when the keys other than the stitching time key, return key and start/stop key are depressed in the pattern selection process control (S31: Yes, S32, S33, S34: No), the process corresponding to the depressed key is executed (S35), whereupon the routine returns to S31. When the start/stop key 21 is depressed (S31: Yes, S32, S33: No, S34: Yes), an embroidery stitching control (not shown) is executed. When the embroidery stitching control ends (S39: Yes), the routine returns to S10 of the embroidery pattern display control.

As described, when several embroidery patterns belonging to the selected category are being displayed in the display unit 20, whether the stitching periods of time of the displayed embroidery patterns are to be computed or not can optionally be determined. Only when the stitching time key is depressed to request displaying the stitching time, the stitching time is displayed. Therefore, embroidery stitching efficiency can be increased. Further, because the computed stitching periods of time are displayed in the display unit 20 in conjunction with the corresponding embroidery pattern, the operator can select one of the embroidery patterns in terms of the stitching periods of time displayed for all the embroidery patterns.

When the stitching period of time is computed for a particular embroidery pattern out of several stitching patterns displayed in the display unit 20, the operator can readily recognize the stitching period of time for the embroidery pattern which the operator intends to stitch.

Figure 11:
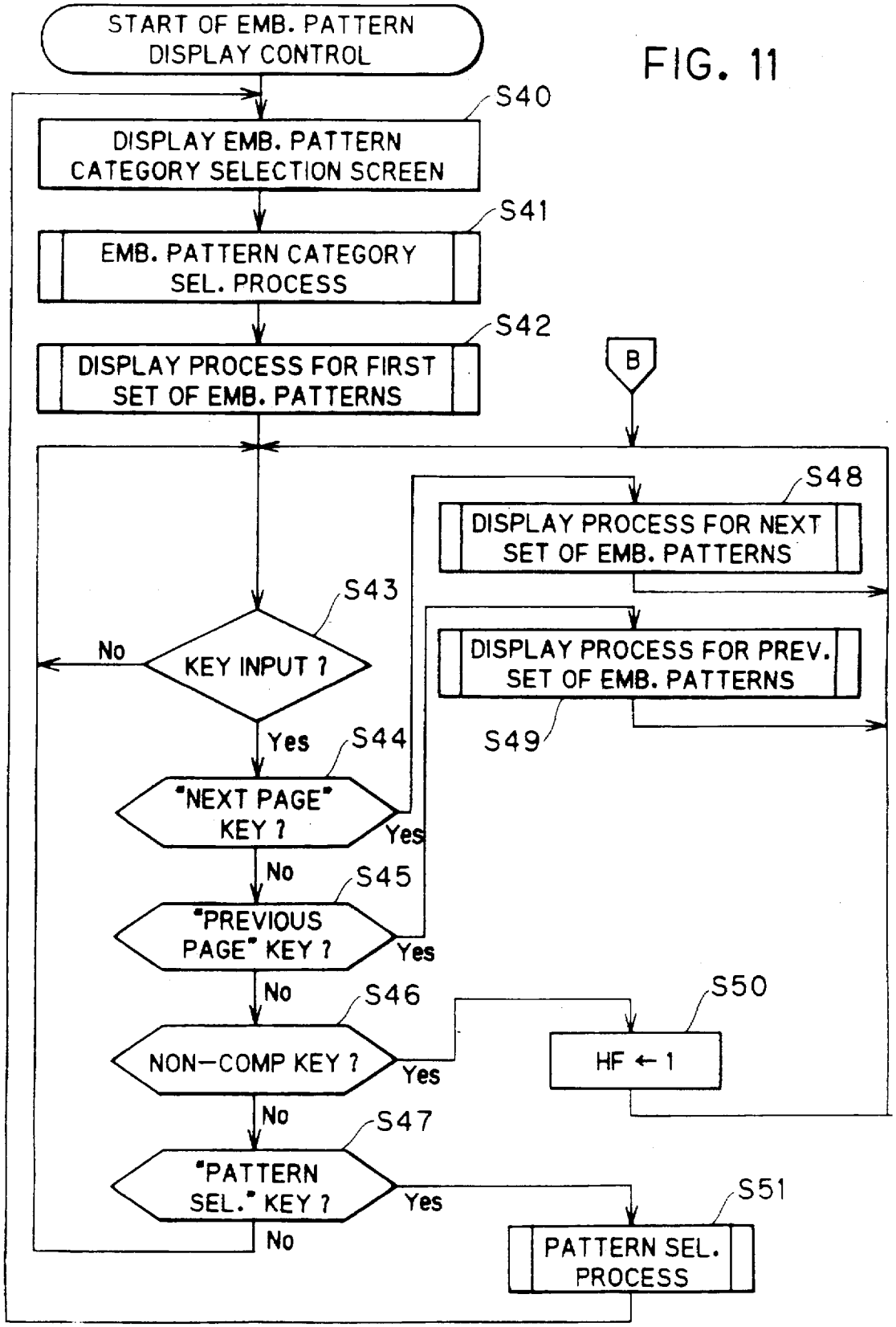
FIG. 11 is a flowchart illustrating an embroidery pattern display control routine according to a modified embodiment of the present invention.

The flowchart shown in FIG. 11 is a modification of the above-described embodiment, in which the embroidery pattern display control is partially modified. In this modification, when the computation of the stitching period of time is not to be done, only the embroidery stitching is performed.

Figure 4:
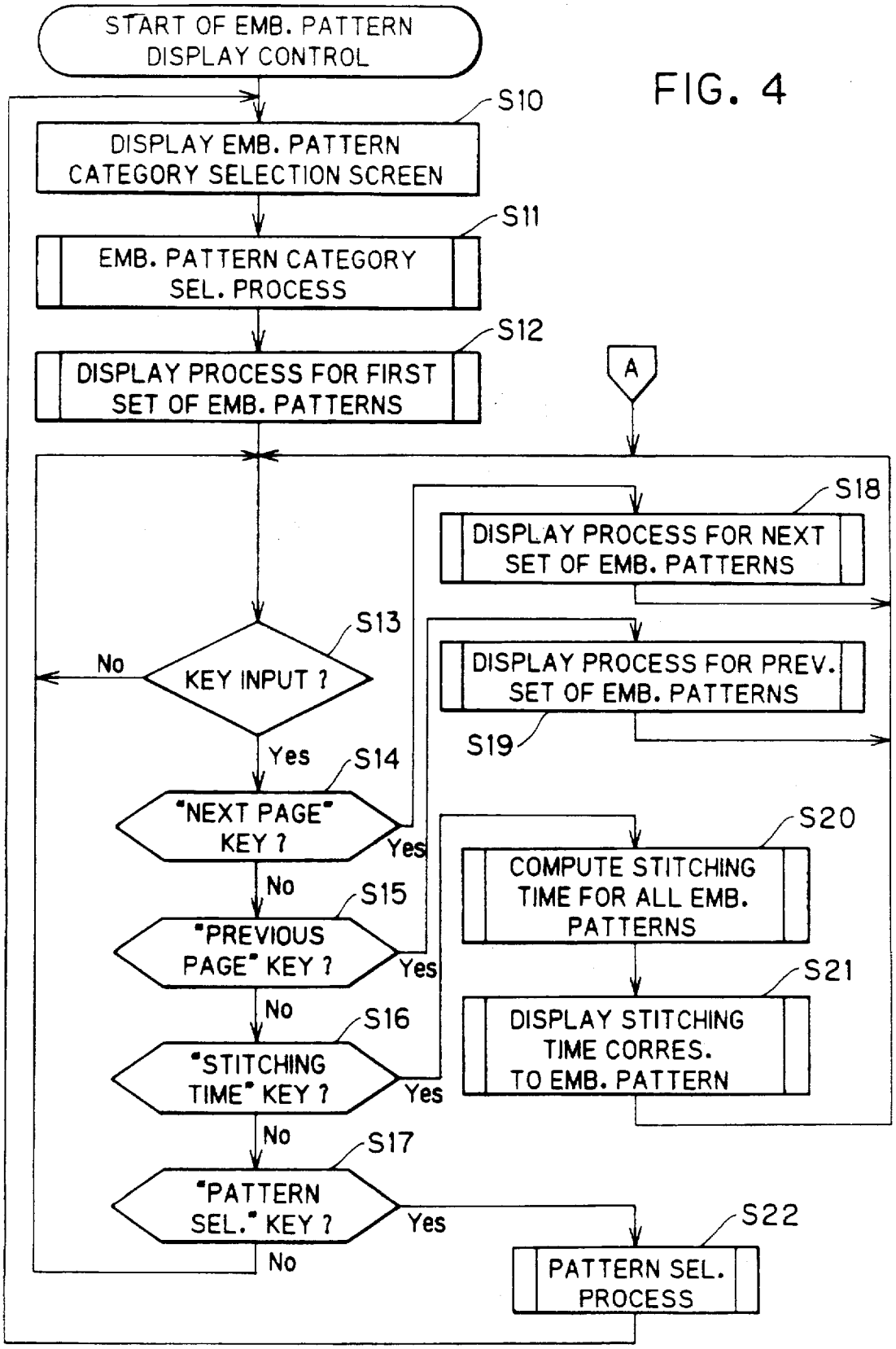
FIG. 4 is a flowchart illustrating an embroidery pattern display control routine according to the embodiment of the present invention.
Figure 5:
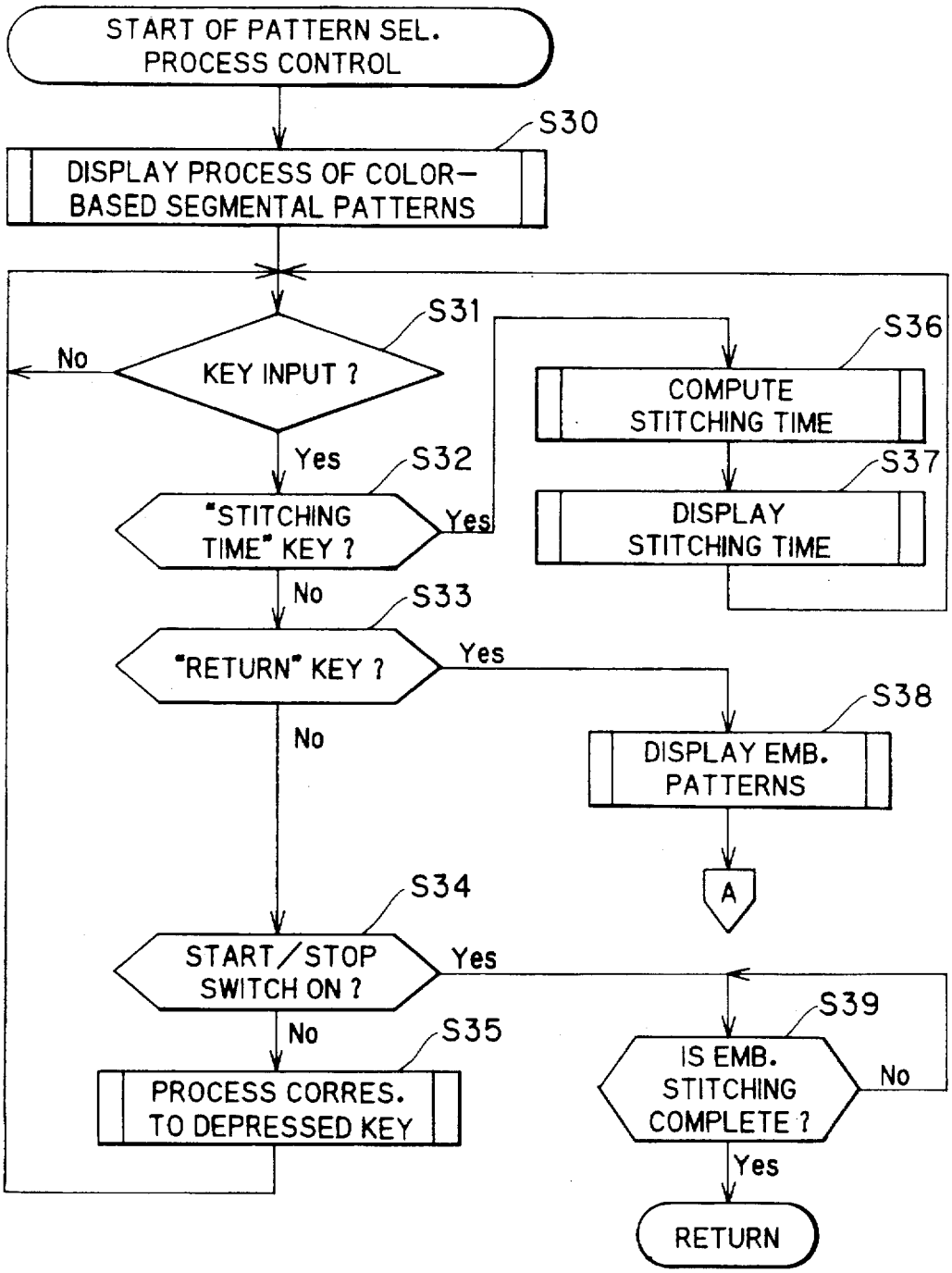
FIG. 5 is a flowchart illustrating a pattern selection process control routine according to the embodiment of the present invention.
Figure 13:
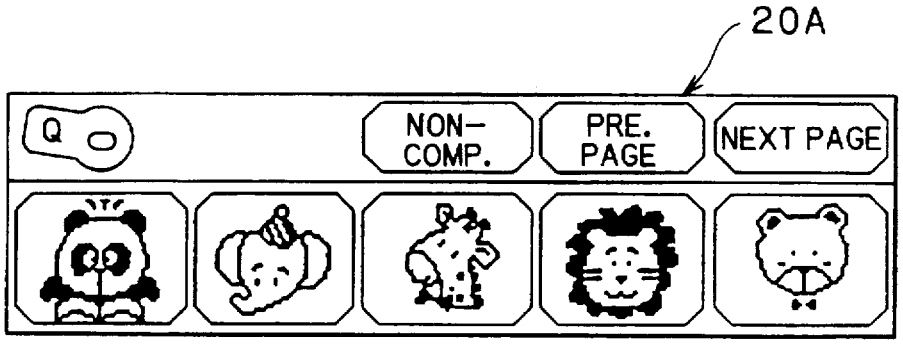
FIG. 13 is an explanatory diagram showing a group of animal embroidery patterns displayed in the display unit according to a modified embodiment of the present invention.

In the flowchart shown in FIG. 11, the processes in S40 through 49 are similar to those in S10 through S19 in the embroidery stitching display control shown in FIG. 4. In S40 through S42, when the category of, for example, "Animals" is selected, a first five animal embroidery patterns corresponding to the first to fifth embroidery patterns stored in the card ROM 23 are displayed in the display 20*a* as shown in FIG. 13. When a non-computation key is depressed so as to prohibit computation of the stitching period of time of the embroidery patterns (S43: Yes, S44, S45: No, S46: Yes), a non-computation flag HF is set (S50), whereupon the routine returns to S43.

Figure 12:
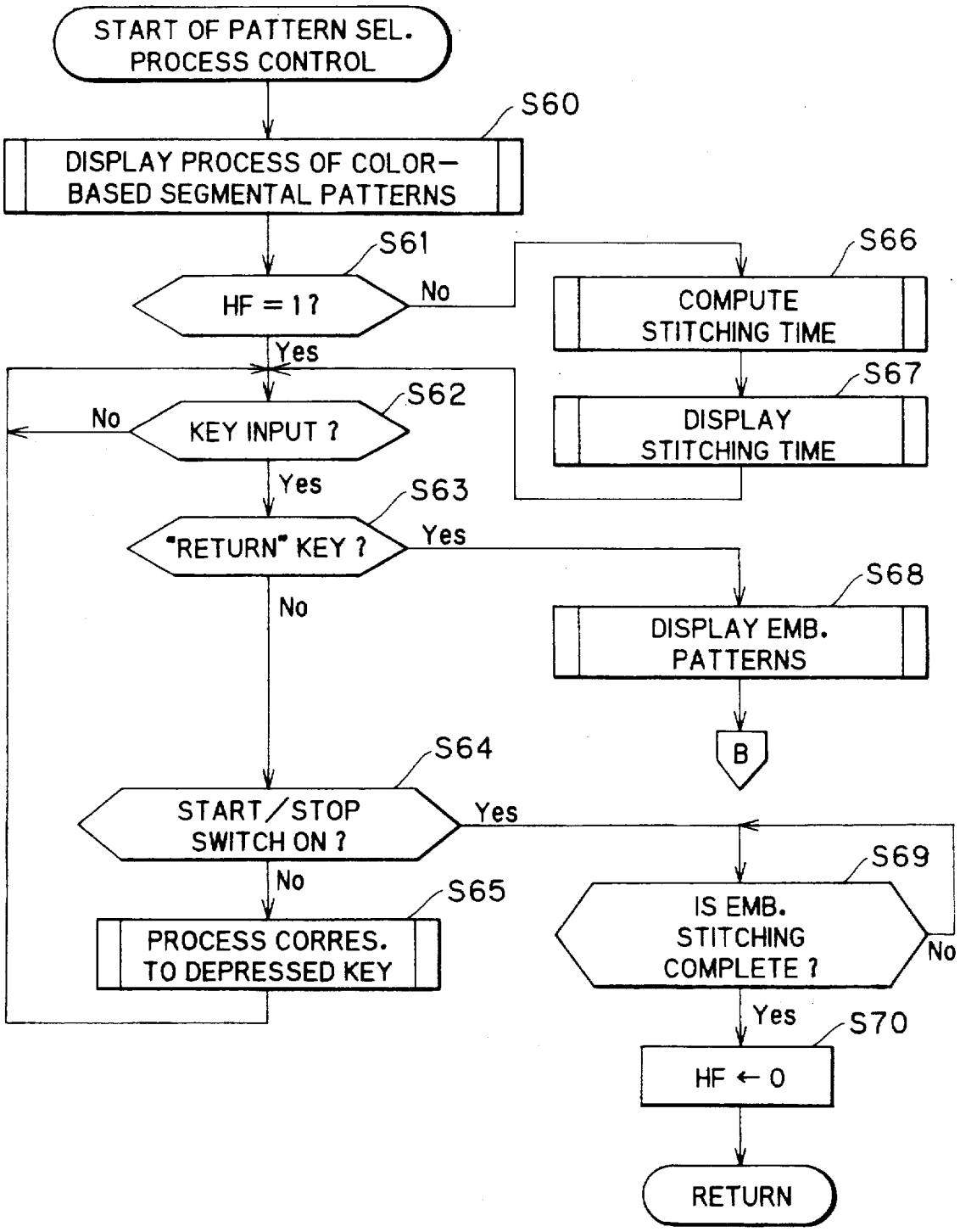
FIG. 12 is a flowchart illustrating a pattern selection process control routine according to a modified embodiment of the present invention.

When the touch key 20*a* corresponding to the desired embroidery pattern among those displayed in the display unit 20*a* is depressed (S43: Yes, S44 through S46: No, S47: Yes), a pattern selection process control (see FIG. 12) is executed (S51). This control is also similar to the pattern selection process control illustrated in FIG. 5. If the non-computation flag HF has been set when a plurality of color-based pattern components are sequentially displayed in an order to be stitched (S60, S61: Yes), computation of the stitching period of time to be executed in S66 through S67 is prohibited. When the flag HF has not been set (S61: No), the stitching periods of time are computed in S66 and S67 similar to S36 and S37 and the resultant stitching periods of time are displayed in the display unit 20*a*. When the start/stop key 21 is depressed (S62: yes, S63: No, S64: Yes), the embroidery stitching control is executed. When execution of the embroidery stitching control ends (S69: Yes), the non-computation flag HF is reset (S70), whereupon this control is ended and the routine returns to S40 of the embroidery pattern display control.

As described, because the computation of the stitching period of time can be omitted if so desired, embroidery stitching can readily be started by saving the time needed for the manipulation of the keys and computation of the time. Therefore, the embroidery stitching can be performed with good efficiency.

While only one exemplary embodiment of this invention has been described in detail, those skilled in the art will recognize that there are many possible modifications and variations which may be made in this exemplary embodiment while yet retaining many of the novel features and advantages of the invention. For example, although the above-described embodiment describes various controls executed when one embroidery pattern is selected, the present invention is applicable to the cases where a single embroidery is to be stitched by combining a plurality of embroidery patterns. In this case, the operator can select whether a total stitching period of time is to be displayed or not, whether stitching periods of time for all of the plurality of embroidery patterns are to be displayed at a time or not, or whether a stitching period of time is to be display or not on an individual embroidery pattern basis.

A modification may be made so that the card ROM 23 stores only the pattern display data regarding a plurality of preselected embroidery patterns and the embroidery data is obtained by developing the pattern display data. Conversely, the card ROM 23 may store only the embroidery data and the pattern display data may be obtained by developing the embroidery data. The card ROM 23 may store pattern data that can be developed into the embroidery data and the pattern display data. In the latter case, the pattern data are developed into the pattern display data and the embroidery data.

It is also possible to determine whether a stitching period of time is to be computed or not for pattern data that is automatically read from an external memory, such as card ROM. The computation of the stitching period of time can be canceled before completion of the computation.

Further, the present invention is applicable not only to an electrically controlled sewing machines but also to various types of sewing machines with no provision of a stitching mechanism, including a sewing machine that stitches an embroidery while moving a needle relative to an embroidery frame, and a sewing machine that stitches an embroidery while moving a fabric of workpiece back and forth and also left and right directions with a feed dog.

What is claimed is:

1. A stitching data processing device comprising:

a display unit;

data storage means for storing a plurality of pieces of pattern data, each of said plurality of pieces of pattern data relating to a plurality of embroidery patterns, each of said plurality of embroidery patterns being stitched by at least one color thread;

pattern display control means for displaying at least one embroidery pattern in said display unit based on a selected one of said plurality of pieces of pattern data;

input means for inputting a time display instruction for instructing to display in said display unit a stitching period of time for said at least one embroidery pattern, the time display instruction being optionally input by an operator;

time computing means for computing the stitching period of time for said at least one embroidery pattern when the operator inputs the time display instruction with said input means, and for outputting time data representative of a computed stitching period of time, said time computing means not computing the stitching period of time for said at least one embroidery pattern displayed in said display unit when the operator does not input the time display instruction with said input means; and time display control means for displaying the computed stitching period of time in said display unit based on the time data output from said time computing means.

2. The stitching data processing device according to claim 1, wherein said time computing means computes the stitching period of time on an embroidery pattern basis, and wherein said time display control means displays the computed stitching period of time in association with a corresponding embroidery pattern displayed in said display unit.

3. The stitching data processing device according to claim 2, further comprising category display control means for displaying in said display unit a plurality of categories corresponding to said plurality of pieces of pattern data, respectively, and a category selection means for allowing the operator to select a category out of said plurality of categories, and wherein said pattern display control means displays a predetermined number of embroidery patterns in said display unit based on one of said plurality of pieces of pattern data corresponding to the category selected by the operator.

4. The stitching data processing device according to claim 3, wherein said category selection means comprises a plurality of touch switches provided corresponding to said plurality of categories displayed in said display unit.

5. The stitching data processing device according to claim 4, wherein each of said plurality of touch switches comprises a transparent electrode disposed in an overlapping relation to the corresponding category displayed in said display unit.

6. The stitching data processing device according to claim 5, wherein said data storage means stores pattern display data, embroidery pattern data, and a leading address of the embroidery pattern data with respect to each of said plurality of embroidery patterns.

7. The stitching data processing device according to claim 6, wherein said pattern display control means comprises means for sequentially displaying said predetermined number of embroidery patterns in said display unit based on the pattern display data and the leading addresses of said plurality of embroidery patterns.

8. The stitching data processing device according to claim 1, further comprising selection means for allowing the operator to select one of a predetermined number of embroidery patterns displayed in said display unit, said selection means being operative when the operator has not yet inputted the time display instruction with said input means, and segmental embroidery pattern display control means for displaying segmental embroidery patterns, each of said segmental embroidery patterns being extracted on a color thread basis from said one of said predetermined number of embroidery patterns selected by the operator.

9. The stitching data processing device according to claim 8, wherein said segmental embroidery patterns are displayed sequentially in an order of stitching of said one of said predetermined number of embroidery patterns selected by the operator.

10. The stitching data processing device according to claim 9, wherein when the operator inputs the time display instruction with said input means under a condition when the operator has selected said one of said predetermined number of embroidery patterns, said time computing means computes a stitching time of the embroidery pattern selected by the operator and said time display control means displays the computed stitching period of time for the selected embroidery pattern in said display unit.

11. The stitching data processing device according to claim 10, further comprising execution means for executing a stitching of the selected embroidery pattern, said execution means being operated by the operator.

12. The stitching data processing device according to claim 1, wherein when a plurality of embroidery patterns are displayed in said display unit, said time computing means computes the stitching period of time of at least one embroidery pattern selected from the plurality of embroidery patterns displayed in said display unit, and wherein said time display controlling means displays the computed stitching period of time corresponding to said at least one embroidery pattern.

13. A stitching data processing device comprising:

a display unit;

data storage means for storing embroidery data for a plurality of embroidery patterns, each of said plurality of embroidery patterns being stitched by at least one color thread;

pattern display control means for displaying a predetermined number of embroidery patterns in said display unit based on the embroidery data;

time computing means for computing a stitching period of time for each of the predetermined number of embroidery patterns based on the embroidery data and for outputting time data representative of a computed stitching period of time;

selection means for selecting whether or not computation of the stitching period of time by said time computing means is prohibited; and prohibiting means for prohibiting said time computing means from computing the stitching period of time when said selection means indicates that computation of the stitching period of time is prohibited, wherein said plurality of embroidery patterns are displayed in said display unit regardless of whether or not computation of the stitching period of time is prohibited.

14. The stitching data processing device according to claim 13, further comprising embroidery pattern selection means for allowing the operator to select one of said predetermined number of embroidery patterns displayed in said display unit, and segmental embroidery pattern display control means for displaying segmental embroidery patterns, each of said segmental embroidery patterns being extracted on a color thread basis from said one of said predetermined number of embroidery patterns selected by the operator.

15. The stitching data processing device according to claim 14, wherein said segmental embroidery patterns are displayed sequentially in an order of stitching of said one of said predetermined number of embroidery patterns selected by the operator.

16. The stitching data processing device according to claim 15, wherein when said selection means indicates that computation of the stitching period of time is not prohibited, said time computing means computes a stitching time of the embroidery pattern selected by the operator and said time display control means displays the computed stitching period of time for the selected embroidery pattern in said display unit.

17. The stitching data processing device according to claim 16, further comprising execution means for executing a stitching of the selected embroidery pattern, said execution means being operated by the operator.

* * * * *